US006442277B1

(12) United States Patent
Lueck et al.

(10) Patent No.: US 6,442,277 B1
(45) Date of Patent: Aug. 27, 2002

(54) METHOD AND APPARATUS FOR LOUDSPEAKER PRESENTATION FOR POSITIONAL 3D SOUND

(75) Inventors: Charles D. Lueck; Alec C. Robinson, both of Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/443,185

(22) Filed: Nov. 19, 1999

Related U.S. Application Data

(60) Provisional application No. 60/113,529, filed on Dec. 22, 1998.

(51) Int. Cl.[7] ..... H04R 5/00; H04R 5/02

(52) U.S. Cl. ..... 381/17; 381/1; 381/300; 381/310

(58) Field of Search ..... 381/17, 1, 310, 381/300

(56) References Cited

U.S. PATENT DOCUMENTS

| | | | | | |
|---|---|---|---|---|---|
| 5,339,363 | A | * | 8/1994 | Fosgate | 381/17 |
| 5,521,981 | A | * | 5/1996 | Gehring | 381/17 |
| 6,243,476 | B1 | * | 6/2001 | Gardner | 381/1 |
| 6,307,941 | B1 | * | 10/2001 | Tanner, Jr. et al. | 381/17 |

* cited by examiner

*Primary Examiner*—Forester W. Isen
*Assistant Examiner*—Laura A. Grier
(74) *Attorney, Agent, or Firm*—Robert L. Troike; Frederick J. Telecky, Jr.

(57) ABSTRACT

A method and device for placement of sound sources in three-dimensional space via two loudspeakers. This technique uses an efficient implementation which consists of binaural signal processing and loudspeaker crosstalk cancellation, followed by panning into the left and right loudspeakers. For many applications, the binaural signal processing and crosstalk cancellation can be performed offline and stored in a file. Because, in this situation, panning is the only required operation, this technique results in a low-computation, real-time system for positional 3D audio over loudspeakers.

12 Claims, 5 Drawing Sheets

METHOD AND APPARATUS FOR LOUDSPEAKER PRESENTATION FOR POSITIONAL 3D SOUND

This application claims priority under 35 USC §119(e) (1) of provisional application No. 60/113,529, filed Dec. 12, 1998.

FIELD ON INVENTION

This invention relates to method and apparatus for the presentation of spatialized sound over loudspeakers.

BACKGROUND OF THE INVENTION

Sound localization is a term which refers to the ability of a listener to estimate direction and distance of a sound source originating from a point in three dimensional space, based the brain's interpretation of signals received at the eardrums. Research has indicated that a number of physiological and psychological cues exist which determine our ability to localize a sound. Such cues may include, but not necessarily be limited to, interaural time delays (ITDs), interaural intensity differences (IIDs), and spectral shaping resulting from the interaction of the outer ear with an approaching sound wave.

Audio spatialization, on the other hand, is a term which refers to the synthesis and application of such localization cues to a sound source in such a manner as to make the source sound realistic. A common method of audio spatialization involves the filtering of a sound with the head-related transfer functions (HRTFs)—position-dependent filters which represent the transfer functions of a sound source at a particular position in space to the left and right ears of the listener. The result of this filtering is a two-channel signal that is typically referred to as a binaural signal. This situation is depicted by the prior art illustration at FIG. 1. Here, $H_I$ represents the ipsilateral response (loud or near side) and $H_C$ represents the contralateral response (quiet or far side) of the human ear. Thus, for a sound source to the right of a listener, the ipsilateral response is the response of the listener's right ear, whereas the contralateral response is the response of the listener's left ear. When played back over headphones, the binaural signal will give the listener the perception of a source emanating from the corresponding position in space. Unfortunately, such binaural processing is computationally very demanding, and playback of binaural signals is only possible over headphones, not over loudspeakers.

Presenting a binaural signal directly over a pair of loudspeakers is ineffective, due to loudspeaker crosstalk, i.e., the part of the signal from one loudspeaker which bleeds over to the far ear of the listener and interferes with the signal produced by the other loudspeaker. In order to present a binaural signal over loudspeakers, crosstalk cancellation is required. In crosstalk cancellation, a crosstalk cancellation signal is added to one loudspeaker to cancel the crosstalk which bleeds over from the other loudspeaker. The crosstalk component is computed using the interaural transfer function (ITF), which represents the transfer function from one ear of the listener to the other ear. This crosstalk component is then added, inversely, to one loudspeaker in such a way as to cancel the crosstalk from the opposite loudspeaker at the ear of the listener.

Spatialization of sources for presentation over loudspeakers is computationally very demanding since both binaural processing and crosstalk cancellation must be performed for all sources. FIG. 2 shows a prior art implementation of a positional 3D audio presentation system using HRTF filtering (binaural processing block) and crosstalk cancellation. Based on given positional information, a lookup must be performed for the left and right ears to determine appropriate coefficients to use for HRTF filtering. A mono input source M is then filtered using the left and right ear HRTF filters, which may be FIR or IIR, to produce a binaural signal $^{I}B$ and $^{C}B$. This binaural signal is then processed by a crosstalk cancellation module 2*a* to enable playback over loudspeakers. For many applications, this computational burden is too large to be practical for real-time operation. Furthermore, since a different set of HRTFs must be used for each desired source position, the number of filter coefficients which needs to be stored is large, and the use of time-varying filters (in the binaural processing block) is required in order to simulate moving sources.

A prior art approach (U.S. Pat. No. 5,521,981, Louis S. Gehring) to reducing the complexity requirements for 3D audio presentation systems is shown in FIG. 3. In this approach, binaural signals for several source positions are precomputed via HRTF filtering. Typically, these positions are chosen to be front, rear, left, and right. To place a source at a particular azimuth angle, direct interpolation is performed between the binaural signals of the nearest two positions. A disadvantage to this approach, particularly for large source files, is the increase in storage required to store the precomputed binaural signals. Assuming that the HRTFs are symmetric about the median plane (the plane through the center of the head which is normal to line intersecting the two ears), storage requirements for this approach are 4 times that of the original monophonic input signal, i.e., each of the front and the back positions require storage equivalent to the one monophonic input because the contralateral and ispilateral responses are identical, and the left and the right positions can be represented by a binaural pair since the ipsilateral and contralateral response are simply reversed. In addition, presenting the resulting signal over loudspeakers L and R, as opposed to headphones, requires additional computation for the crosstalk cancellation procedure.

SUMMARY OF THE INVENTION

In accordance with one embodiment of the present invention, a method and apparatus for the placement of sound sources in three-dimensional space with two loudspeakers is provided by binaural signal processing and loudspeaker crosstalk cancellation, followed by panning into left and right speakers.

DESCRIPTION OF PREFERRED EMBODIMENTS

Figure 4:
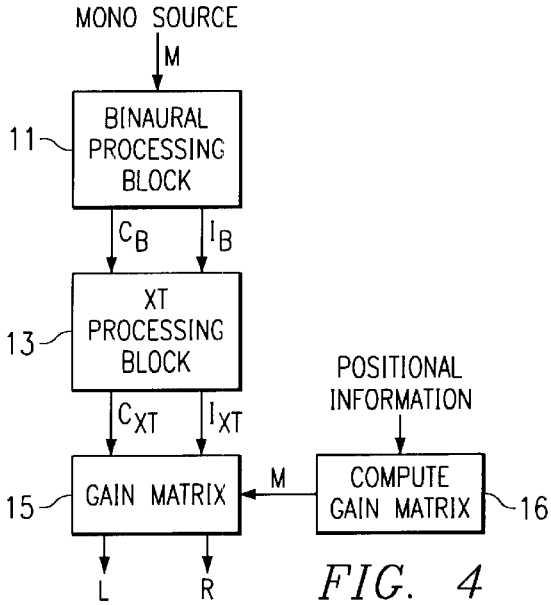
FIG. 4 is a block diagram of one embodiment of the present invention.

A block diagram of the present invention is shown in FIG. 4. The invention can be broken down into three main processing blocks: the binaural processing block 11, the crosstalk processing block 13, and the gain matrix device 15.

Figure 1:
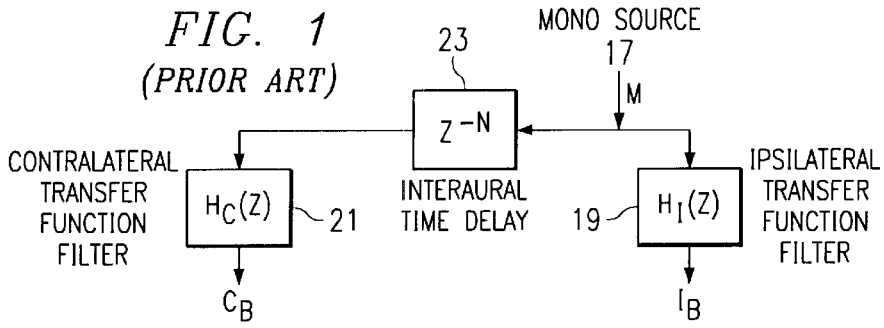
FIG. 1 (PRIOR ART)
FIG. 1 illustrates first prior art realization of the binaural processing block.
Figure 2:
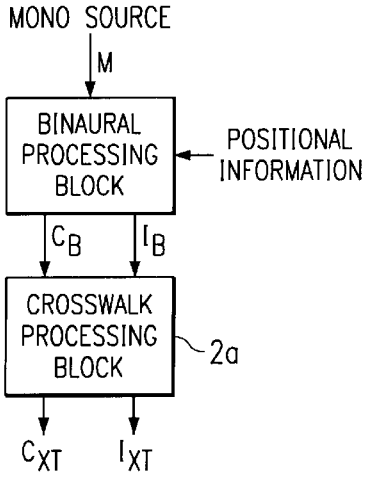
FIG. 2 (PRIOR ART)
FIG. 2 illustrates prior art, binaural processor with crosstalk cancellation.
Figure 5:
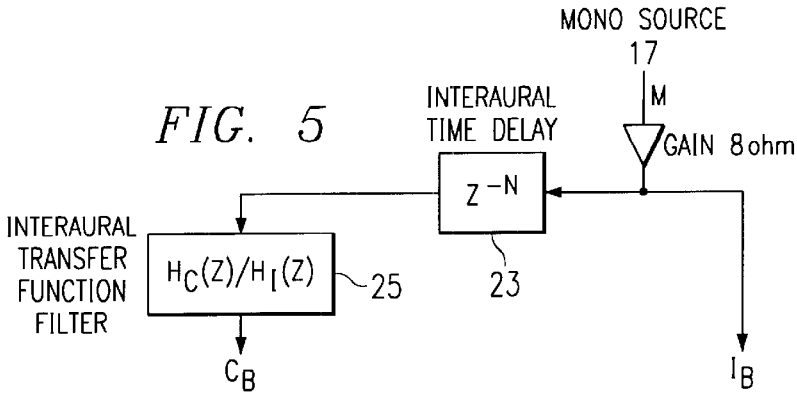
FIG. 5 is a second realization of the binaural processing block.

The purpose of the binaural processing block is to apply head-related transfer function (HRTF) filtering to a monaural input source M to simulate the direction-dependent sound pressure levels at the eardrums of a listener from a point source in space. One realization of the binaural processing block 11 is shown in FIG. 1 and another realization of block 11 is shown in FIG. 5. In the first realization in FIG. 1, a monaural sound source 17 is filtered using the ipsilateral and contralateral HRTFs 19 and 21 for a particular azimuth angle. A time delay 23, representing the desired interaural time delay between the ipsilateral (loud or near side) and contralateral (quiet or far side) ears, is also applied to the contralateral response. In the second realization in FIG. 5, the preferred realization, the ipsilateral response is unfiltered, while the contralateral response is filtered at filter 25 according to the interaural transfer function (ITF), i.e., the transfer function between the two ears, as indicated in FIG. 5. This helps to reduce the coloration which is typically associated with binaural processing. See Applicants' U.S. patent application Ser. No. 60/089,715 filed Jun. 18, 1998 by Alec C. Robinson and Charles D. Lueck, titled "Method and Device for Reduced Coloration of 3D Sound." This application is incorporated herein by reference. At the output of the binaural processing block, $I_B$ represents the ispilateral response and $C_B$ represents the contralateral response for a source which has been binaurally processed.

Figure 6:
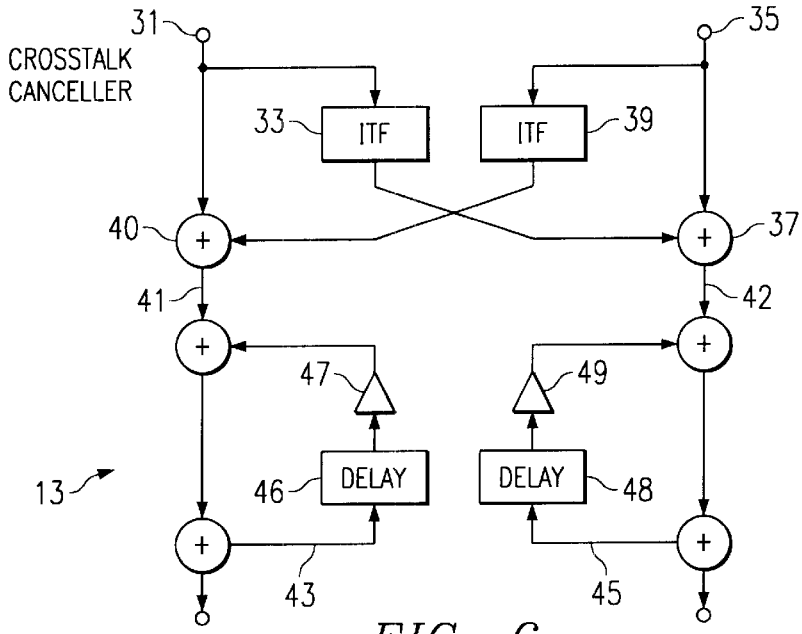
FIG. 6 is a block diagram of the crosstalk (XT) processor.

After the monaural signal is binaurally processed, the resulting two-channel output undergoes crosstalk cancellation so that it can be used in a loudspeaker playback system. A realization of the crosstalk cancellation processing subsystem block 13 is shown in FIG. 6. In this subsystem block 13, the contralateral input 31 is filtered by an interaural transfer function (ITF) 33, negated, and added at adder 37 to the ispilateral input at 35. Similarly, the ispilateral input at 35 is also filtered by an ITF 39, negated, and added at adder 40 to the contralateral input 31. In addition, each resulting crosstalk signal at 41 or 42 undergoes a recursive feedback loop 43 and 45 consisting of a simple delay using delays 46 and 48 and a gain control device (for example, amplifiers) 47 and 49. The feedback loops are designed to cancel higher order crosstalk terms, i.e., crosstalk resulting from the crosstalk cancellation signal itself. The gain is adjusted to control the amount of higher order crosstalk cancellation that is desired. See also Applicants' U.S. application Ser. No. 60/092,383 filed Jul. 10, 1998, by same inventors herein of Alec C. Robinson and Charles D. Lueck, titled "Method and Apparatus for Multi-Channel Audio over Two Loudspeakers." This application is incorporated herein by reference.

Figure 7:
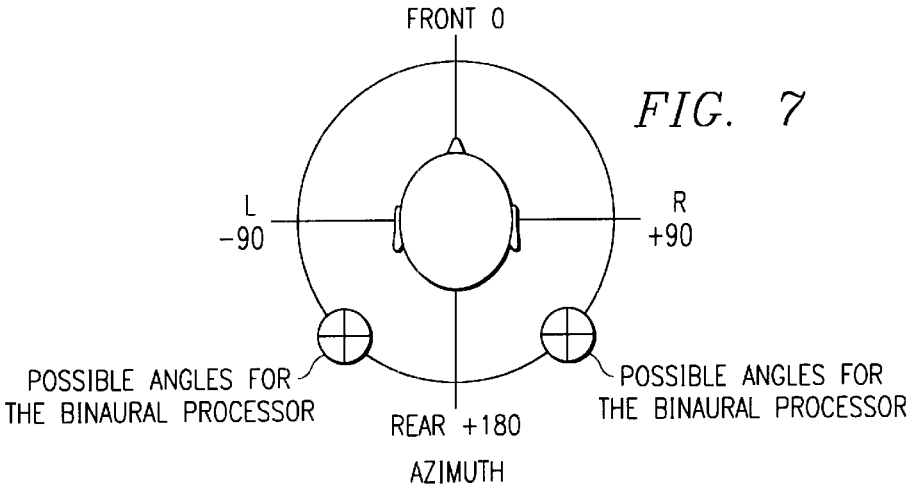
FIG. 7 is a sketch illustrating possible azimuth angles for the binaural processor.

For the present invention, the binaural processor is designed using a fixed pair of HRTFs corresponding to an azimuth angle behind the listener, as indicated in FIG. 7. Typically, an azimuth angle of either +130 or −130 degrees can be used.

As described below, the perceived location of the sound source can be controlled by varying the amounts of contralateral and ispilateral responses which get mapped into the left and right loudspeakers. This control is accomplished using the gain matrix. The gain matrix performs the following matrix operation:

$$\begin{bmatrix} L \\ R \end{bmatrix} = \begin{bmatrix} g_{CL} & g_{IL} \\ g_{CR} & g_{IR} \end{bmatrix} \begin{bmatrix} C_{XT} \\ I_{XT} \end{bmatrix}$$

Here, $I_{XT}$ represents the ipsilateral response after crosstalk cancellation, $C_{XT}$ represents the contralateral response after crosstalk cancellation, L represents the output directed to the left loudspeaker, and R represents the output directed to the right loudspeaker. The four gain terms thus represent the following:

$g_{CL}$: Amount of contralateral response added to the left loudspeaker.

$g_{IL}$: Amount of ipsilateral response added to the left loudspeaker.

$g_{CR}$: Amount of contralateral response added to the right loudspeaker.

$g_{IR}$: Amount of ipsilateral response added to the right loudspeaker.

Figure 8:
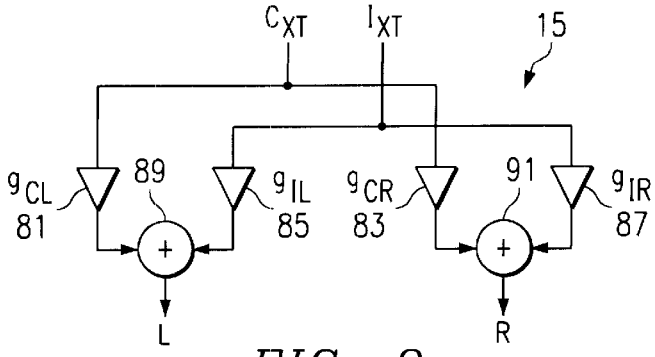
FIG. 8 is a block diagram of the gain matrix according to one embodiment of the present invention.

A diagram of the gain matrix device 15 is shown in FIG. 8. The crosstalk contralateral signal ($C_{XT}$) is applied to gain control device 81 and gain control device 83 to provide signals $g_{CL}$ and $g_{CR}$. The gain control 81 is coupled to the left loudspeaker and the gain control device 83 connects the $C_{XT}$ signal to the right loudspeaker. The crosstalk ipsilateral signal $I_{XT}$ is applied through gain control device 85 to the left loudspeaker and through the gain control device 87 to the right loudspeaker to provide signals $g_{IL}$ and $g_{IR}$, respectively. The outputs $g_{CL}$ and $g_{IL}$ at gain control devices 81 and 85 are summed at adder 89 which is coupled to the left loudspeaker. The outputs $g_{CR}$ and $g_{IR}$ at gain control devices 83 and 87 are summed at adder 91 coupled to the right loudspeaker. By modifying the gain matrix device 15, the perceived location of the sound source can be controlled. To place the sound source at the location of the right loudspeaker, $g_{IR}$ is set to 1.0 while all other gain values are set to 0.0. This places all of the signal energy from the crosstalk-canceled ipsilateral response into the right loudspeaker and, thus, positions the perceived source location to that of the right loudspeaker. Likewise, setting $g_{IL}$ to 1.0 and all other gain values to 0.0 places the perceived source location to that of the left loudspeaker, since all the power of the ispilateral response is directed into the left loudspeaker.

Figure 9:
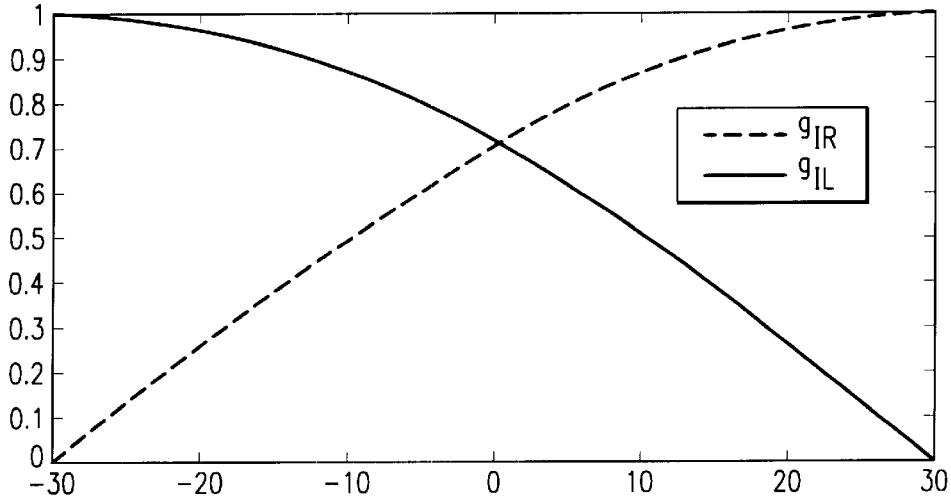
FIG. 9 are gain curves used for positioning sources between −30 degrees and +30 degrees.

To place sources between the speakers (−30 degrees to +30 degrees, assuming loudspeakers placed at +30 and −30 degrees), the ipsilateral response is panned between the left and right speakers. No contralateral response is used. To accomplish this task, the gain curves of FIG. 9 can be applied to $g_{IR}$ and $g_{IL}$ as functions of desired azimuth angle while setting the remaining two gain values to 0.0.

To place a source to the right of the right loudspeaker (+30 degrees to +130 degrees), the amount of contralateral response into the left loudspeaker (controlled by $g_{CL}$) is gradually increased while the amount of ipsilateral response into the right loudspeaker (controlled by $g_{IR}$) is gradually decreased. This can be accomplished using the gain curves shown in FIG. 10.

Figure 10:
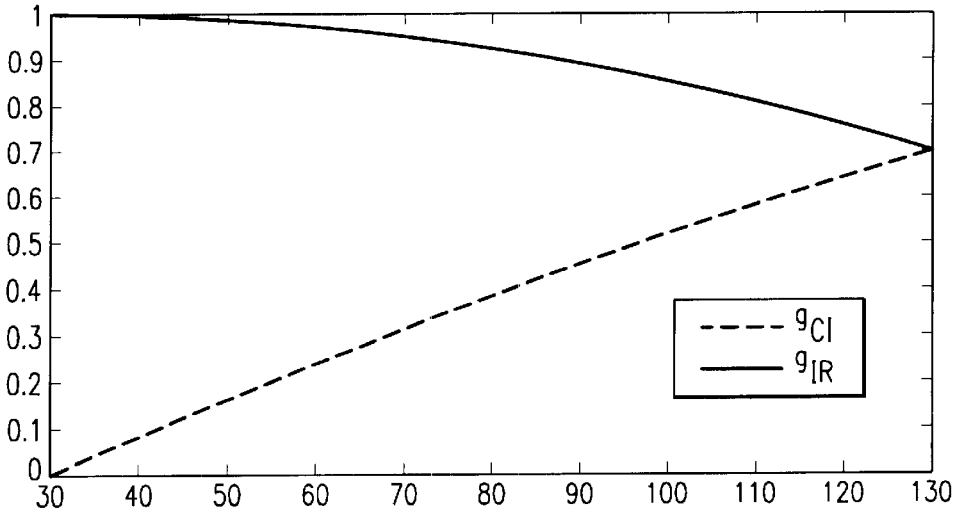
FIG. 10 are gain curves used for positioning sources between +30 degrees and +130 degrees.

As can be noted from FIG. 10, at +130 degrees (behind the listener and to the right), the gain of the ipsilateral response and the contralateral response, namely $g_{IR}$ and $g_{CL}$, are equal, placing the perceived source location to that for which the binaural processor was designed.

Figure 11:
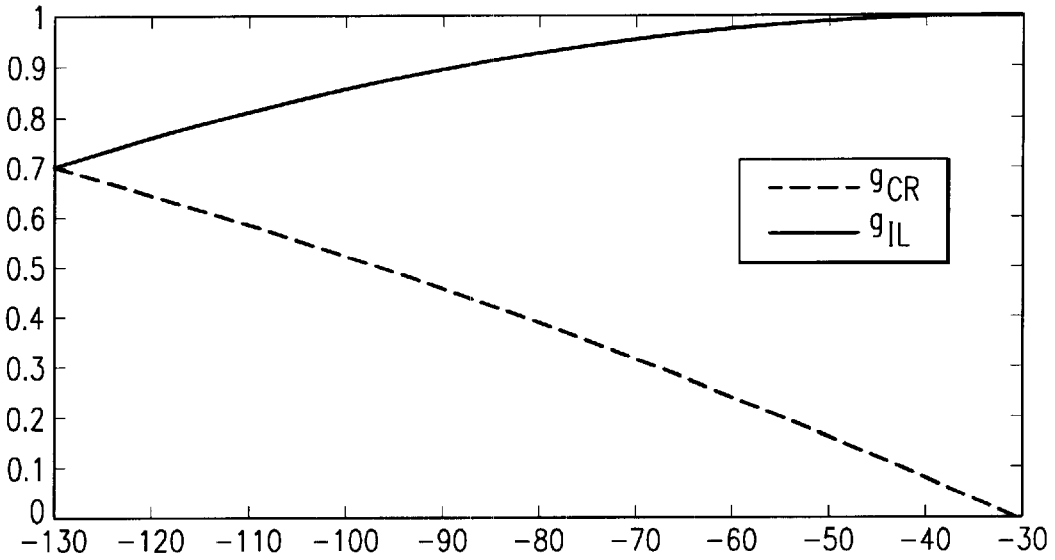
FIG. 11 are gain curves used for positioning sources between −130 degrees and −30 degrees.
Figure 12:
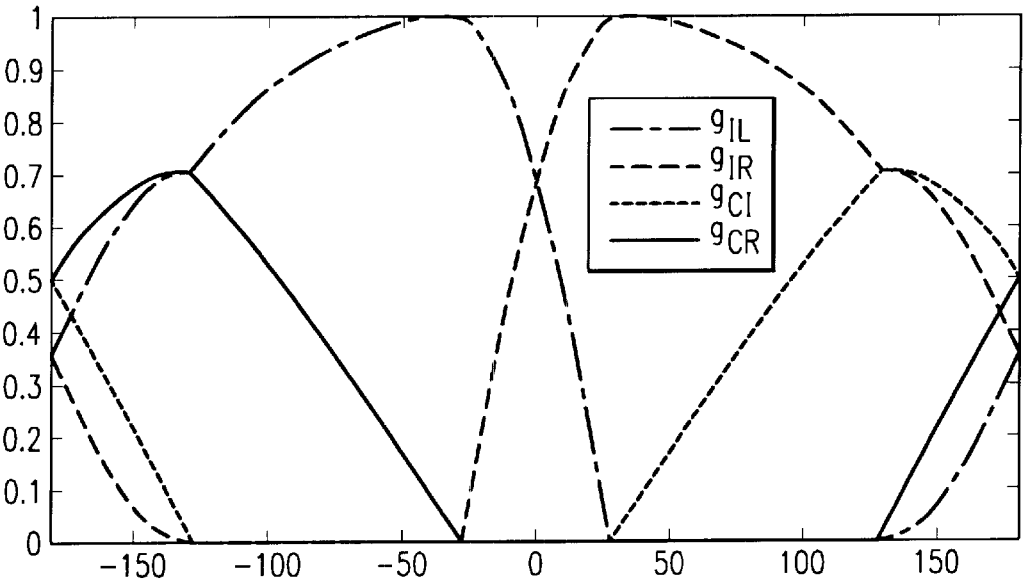
FIG. 12 are gain curves used for positioning sources between −180 degrees and +180 degrees.

Similarly, to place a source to the left of the left loudspeaker (−30 degrees to −130 degrees), the amount of contralateral response into the right loudspeaker (controlled by $g_{CR}$) is gradually increased while the amount of ipsilateral response into the left loudspeaker (controlled by $g_{IL}$) is gradually decreased. This can be accomplished using the gain curves shown in FIG. 11. To place a sound source anywhere in the horizontal plane, from −180 degrees all the way up to 180 degrees, the cumulative gain curve of FIG. 12 can be used.

All gain values are continuous over the entire range of azimuth angle. This results in smooth transitions for moving sources. Mathematically, the gain curves can be represented by the following set of equations:

$$\begin{bmatrix} L \\ R \end{bmatrix} = \begin{cases} \begin{bmatrix} 0 & \sin\left[\frac{\pi}{4} + \frac{\pi}{4}\left(\frac{\theta+130}{100}\right)\right] \\ \sin\left[\frac{\pi}{4} - \frac{\pi}{4}\left(\frac{\theta+130}{100}\right)\right] & 0 \end{bmatrix} \cdot \begin{bmatrix} C_{XT} \\ I_{XT} \end{bmatrix}, \text{ for } -130 \le \theta < -30 \\ \begin{bmatrix} 0 & \sin\left[\frac{\pi}{2} + \frac{\pi}{2}\left(\frac{\theta+30}{60}\right)\right] \\ 0 & \sin\left[\frac{\pi}{2}\left(\frac{\theta+30}{60}\right)\right] \end{bmatrix} \cdot \begin{bmatrix} C_{XT} \\ I_{XT} \end{bmatrix}, \text{ for } -30 \le \theta < +30 \\ \begin{bmatrix} \sin\left[\frac{\pi}{4}\left(\frac{\theta-30}{100}\right)\right] & 0 \\ 0 & \sin\left[\frac{\pi}{2} - \frac{\pi}{4}\left(\frac{\theta-30}{100}\right)\right] \end{bmatrix} \cdot \begin{bmatrix} C_{XT} \\ I_{XT} \end{bmatrix}, \text{ for } +30 \le \theta < +130 \\ \begin{bmatrix} g_{LL} & g_{RL} \\ g_{LR} & g_{RR} \end{bmatrix} \cdot \begin{bmatrix} C_{XT} \\ I_{XT} \end{bmatrix}, \text{ elsewhere} \end{cases}$$

where theta (θ) represents the desired azimuth angle at which to place the source.

Referring to FIG. 4, the positional information indicating the desired position of the sound is applied to a matrix computer 16 that computes the gain at 81, 83, 85 and 87 for $g_{CL}$, $g_{CR}$, $g_{IL}$ and $g_{IR}$.

Figure 13:
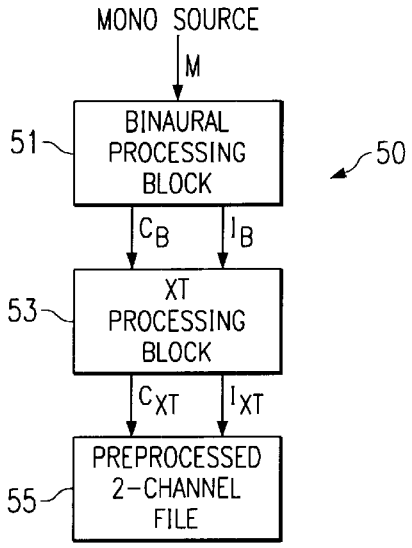
FIG. 13 is a block diagram of the preprocessing procedure.

If the binaural processing crosstalk cancellation is performed offline as a preprocessing procedure, an efficient implementation results which is particularly well-suited for real-time operation. FIG. 13 illustrates a block diagram of the preprocessing system 50. Here, the binaural processing block 51 is the same as that shown in FIG. 1 or 5, and the crosstalk processing block 53 is the same as that shown in FIG. 6. The input to the preprocessing procedure is a monophonic sound source M to be spatialized. The output of the preprocessing procedure is a two-channel output consisting of the crosstalk-canceled ipsilateral $I_{XT}$ and contralateral $C_{XT}$ responses. The preprocessed output can be stored to disk 55 using no more storage than required by a typical stereo signal.

Figure 14:
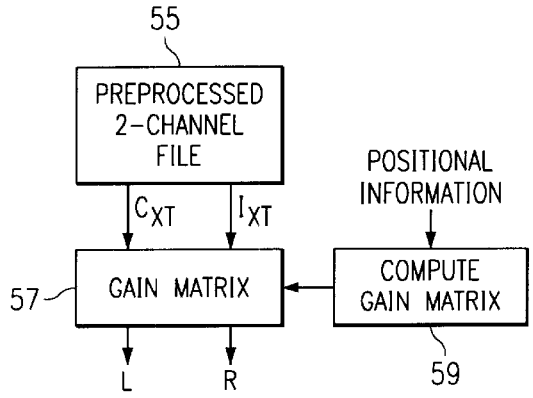
FIG. 14 is a block diagram of a system for positioning a source using preprocessed data.

For sources which have been preprocessed in such a manner, spatialization to any position on the horizontal plane is a simple matrixing procedure as illustrated in FIG. 14. Here, the gain matrix 57 is the same as that shown in FIG. 8. To position the source at a particular azimuth angle, the gain curves shown in FIG. 12 can be used. The desired positional information of the sound is sent to the gain matrix computer 59. The output from computer 59 is applied to the gain matrix device 57 to control the amounts of preprocessed signals to go to the left and right loudspeakers.

Figure 15:
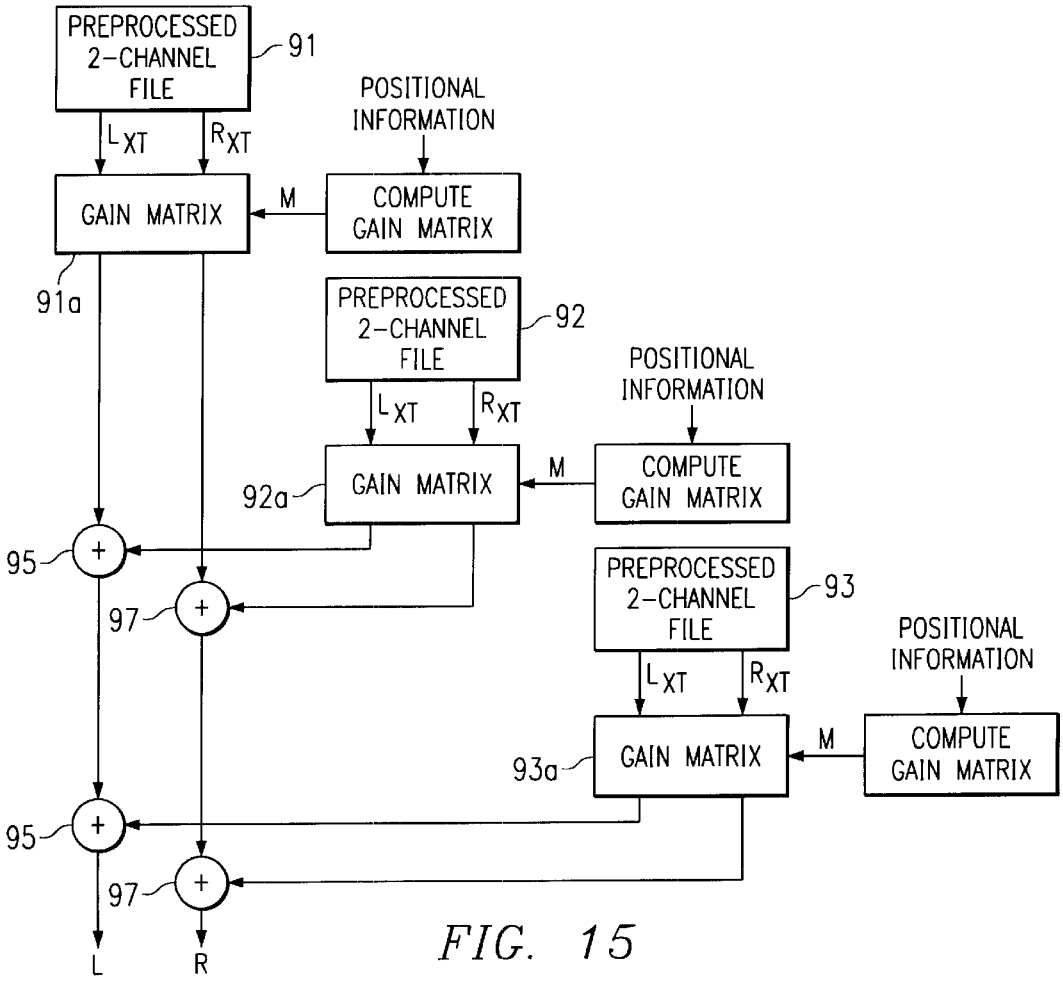
FIG. 15 is a block diagram of a system for positioning multiple sources using preprocessed data.

To position multiple sources using preprocessed data, multiple instantiations of the gain matrix 57 must be used. Such a process is illustrated in FIG. 15. Here, preprocessed input is retrieved from disk 55, for example. Referring to FIG. 15, each of the multiple sources 91, 92 and 93 stored in a preprocessed 2-channel file as provided for in connection with FIG. 13 is applied to a separate corresponding gain matrix 91*a*, 92*a* and 93*a* for separately generating left speaker signals $L_{XT}$ and right speaker signals $R_{XT}$ according to separate positional information. All of multiple signals for left speakers are summed at adders 95 and applied to the left speaker and all of the multiple signals for the right speakers are summed at adders 97 and applied to the right speaker.

The technique presented in this disclosure is for the presentation of spatialized audio sources over loudspeakers. In this technique, most of the burdensome computation required for binaural processing and crosstalk cancellation can be performed offline as a preprocessing procedure. A panning procedure to control the amounts of the preprocessed signal that go into the left and right loudspeakers is all that is then needed to place a sound source anywhere within a full 360 degrees around the user. Unlike prior art techniques, which require a panning among multiple binaural signals, the present invention accomplishes this task using only a single binaural signal. This is made possible by taking advantage of the physical locations of the loudspeakers to simulate frontal sources. The solution has lower computation and storage requirements than prior art, making it well-suited for real-time applications, and it does not require the use of time-varying filters, leading to a high-quality system which is very easy to implement.

Figure 3:
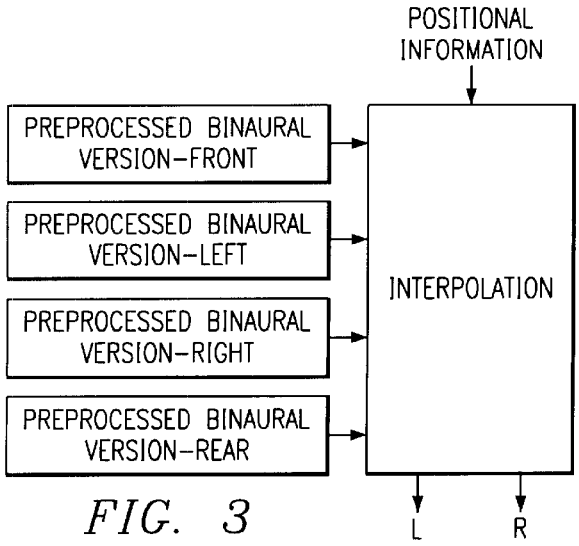
FIG. 3 (PRIOR ART)
FIG. 3 illustrates prior art, preprocessed binaural versions with interpolation.

Compared to the prior art of FIG. 3, the present invention has the following advantages:

1. The preprocessing procedure is much simpler since HRTF filtering only needs to be performed for one source position, as opposed to 4 source positions for the prior art.
2. The present invention requires only half of the storage space: 2 times that of the original monophonic signal versus 4 times that of the original for the prior art. Thus, the preprocessed data can be stored using the equivalent storage of a conventional stereo signal, i.e., compact disc format.
3. Crosstalk cancellation is built into the preprocessing procedure. No additional crosstalk cancellation is needed to playback over loudspeakers.
4. Computational requirements for positioning sources are less. The prior art requires 4 multiplications for all source positions, whereas the present invention requires only 2 multiplications for all source positions except the rear, which requires 4, as indicated in Equation 1.

We claim:

1. A system for loudspeaker presentation of positional 3D sound comprising:

a binaural processor including position-dependent, head-related filtering responsive to a monaural source signal for generating a binaural signal comprising an ipsilateral signal at one channel output and a delayed and filtered contralateral signal at a second channel output wherein said filtered contralateral signal is filtered according to an interaural transfer function;

a crosstalk processor response to said ipsilateral signal and delayed and filtered contralateral signal for generating crosstalk-cancelled ipsilateral signal and crosstalk cancelled contralateral signals;

a left loudspeaker and a right loudspeaker; and a controller coupled to said left loudspeaker and said right loudspeaker responsive to said crosstalk-cancelled ipsilateral signals, said crosstalk cancelled contralateral signals, and positional information indicating the angle of each monaural sound for panning said crosstalk cancelled ipsilateral and contralateral signal into said left loudspeaker and said right loudspeaker according to said positional information by dynamically varying the signal level of said crosstalk cancelled ipsilateral signals and crosstalk cancelled contralateral signals to provide 3D sound.

2. The system of claim 1 wherein said controller varies the signal level of crosstalk cancelled contralateral and crosstalk cancelled ipsilateral signals which get mapped into said left loudspeaker and said right loudspeaker.

3. The system of claim 1 wherein said controller includes a gain matrix device.

4. The system of claim 1 wherein said binaural processor includes a fixed interaural transfer function filter and an interaural time delay for generating the contralateral signal.

5. The system of claim 4 wherein said controller varies the signal level of crosstalk cancelled contralateral signals and crosstalk cancelled ipsilateral signals which get mapped into said left loudspeaker and right loudspeaker.

6. The system of claim 5 wherein said controller includes a gain matrix device.

7. The system of claim 1 wherein said binaural processor includes a fixed ipsilateral transfer function filter coupled to said monaural source and a contralateral transfer function filter and interaural time delay coupled to said monaural source.

8. A method of generating positional 3D sound from a monaural signal comprising the steps of:

binaural processing said monaural signals into an ipsilateral signals and a delayed and filtered contralateral signals filtered according to an interaural transfer function;

crosstalk processing said ipsilateral signals and said delayed and filtered contralateral signals to provide crosstalk cancelled ipsilateral signals and delayed and filtered crosstalk cancelled contralateral signals; and dynamically varying the signal level of said crosstalk cancelled ipsilateral signals and delayed and filtered crosstalk cancelled contralateral signals according to positional information to pan said crosstalk cancelled ipsilateral signals and contralateral signal to left and right loudspeakers.

9. The method of claim 8 wherein said binaural processing includes processing using a fixed interaural transfer function.

10. A system for loudspeaker presentation of positional 3D sound comprising:

a binaural processor including position-dependent, head-related filtering responsive to a monaural source signal for generating a binaural signal comprising an ipsilateral signal at one channel output and a delayed contralateral signal at a second channel output;

a crosstalk processor response to said ipsilateral signal and delayed contralateral signal for generating crosstalk-cancelled ipsilateral signal and crosstalk cancelled contralateral signals;

a left loudspeaker and a right loudspeaker;

a controller including a gain matrix device coupled to said left loudspeaker and said right loudspeaker responsive to said crosstalk-cancelled ipsilateral signals and said crosstalk cancelled contralateral signals for panning said crosstalk cancelled ipsilateral and contralateral signal into said left loudspeaker and said right loudspeaker to provide 3D sound; and a compute gain matrix device responsive to desired positional information for providing signals to control the gain of said gain matrix.

11. A method of generating positional 3D sound from a monaural signal comprising the steps of:

storing a preprocessed two channel file containing crosstalk cancelled ipsilateral signals and crosstalk cancelled contralateral signals;

a left loudspeaker and right loudspeaker; and a controller coupled to said left loudspeaker and said right loudspeaker and responsive to said crosstalk cancelled ipsilateral signals, said crosstalk contralateral signals, and positional information indicating the angle of the sound of each monaural signal for panning said crosstalk signals into said left and right loudspeakers according to positional information by dynamically varying the signal level of said crosstalk cancelled ipsilateral signals and crosstalk cancelled contralateral signals to provide 3D sound.

12. A method of providing positional 3D sound to a left loudspeaker and a right loudspeaker from a plurality of monaural signals comprising the steps of;

storing a preprocessed two-channel file for each of said monaural signals containing crosstalk-cancelled ipsilateral signals and crosstalk-cancelled contralateral signals, a controller coupled to said preprocessed two-channel file for each of said monaural signals and responsive to desired positional information of each monaural sound for panning said crosstalk-cancelled contralateral and crosstalk-cancelled ipsilateral signals from each of said monaural signals according to positional information by dynamically varying the signal level of said crosstalk cancelled ipsilateral signals and crosstalk cancelled contralateral signals into a left loudspeaker channel and into a right loudspeaker channel according to said desired positional information for each monaural signal, a left channel summer coupled to said left loudspeaker for summing said crosstalk cancelled contralateral signals and crosstalk-canceled ipsilateral signals in said left channel, and a right channel summer coupled to said right loudspeaker for summing said cross-talk cancelled contralateral signals and crosstalk cancelled ipsilateral signals in said right channel.

* * * * *